US010502089B2

(12) United States Patent
Cheng et al.

(10) Patent No.: US 10,502,089 B2
(45) Date of Patent: Dec. 10, 2019

(54) GAS TURBINE ENGINE VARIABLE STATOR VANE

(71) Applicant: UNITED TECHNOLOGIES CORPORATION, Hartford, CT (US)

(72) Inventors: Loi Cheng, South Windsor, CT (US); Tracy A. Propheter-Hinckley, Manchester, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 965 days.

(21) Appl. No.: 14/835,849

(22) Filed: Aug. 26, 2015

(65) Prior Publication Data

US 2016/0160676 A1 Jun. 9, 2016

Related U.S. Application Data

(60) Provisional application No. 62/053,368, filed on Sep. 22, 2014.

(51) Int. Cl.

| | |
|---|---|
| ***F01D 17/16*** | (2006.01) |
| ***F01D 17/18*** | (2006.01) |
| ***F01D 9/04*** | (2006.01) |
| ***F04D 29/54*** | (2006.01) |
| ***F01D 17/14*** | (2006.01) |
| ***F04D 29/56*** | (2006.01) |
| ***F04D 27/02*** | (2006.01) |

(52) U.S. Cl.

CPC ..... *F01D 17/167* (2013.01); *F01D 9/041* (2013.01); *F01D 17/143* (2013.01); *F01D 17/18* (2013.01); *F04D 27/0246* (2013.01); *F04D 29/542* (2013.01); *F04D 29/563* (2013.01); *F05D 2220/32* (2013.01); *F05D 2240/12* (2013.01); *F05D 2260/57* (2013.01); *F05D 2270/101* (2013.01); *F05D 2270/20* (2013.01)

(58) Field of Classification Search

CPC ..... F01D 17/143; F01D 17/167; F01D 17/18; F01D 9/041; F04D 27/0246; F04D 29/542; F04D 29/563; F05D 2220/32; F05D 2240/12; F05D 2260/57; F05D 2270/101; F05D 2270/20

USPC ..... 415/148, 151, 159

See application file for complete search history.

(56) References Cited

U.S. PATENT DOCUMENTS 4,119,389 A 10/1978 Gee
4,497,171 A * 2/1985 Corrigan ..... F01D 17/141 415/151
4,705,452 A 11/1987 Karadimas
(Continued)

FOREIGN PATENT DOCUMENTS

| | | |
|---|---|---|
| AT | 505407 | 1/2009 |
| EP | 1522710 | 4/2005 |
| FR | 1399043 | 5/1965 |

OTHER PUBLICATIONS

Extended European Search Report for European Application No. 15186215.8 dated May 19, 2016.

*Primary Examiner* — Mark A Laurenzi
*Assistant Examiner* — Paul W Thiede
(74) *Attorney, Agent, or Firm* — Carlson, Gaskey & Olds, P.C.

(57) ABSTRACT

A gas turbine engine includes a stator stage arranged in a core flow path that includes a vane that is configured to be retractable from the core flow path during engine operation.

15 Claims, 5 Drawing Sheets

(56) References Cited

U.S. PATENT DOCUMENTS

| | | | |
|---|---|---|---|
| 6,769,868 | B2 | 8/2004 | Harrold |
| 2013/0039736 | A1 | 2/2013 | Waugh et al. |

* cited by examiner

GAS TURBINE ENGINE VARIABLE STATOR VANE

CROSS REFERENCE TO RELATED APPLICATION

This application claims priority to U.S. Provisional Application No. 62/053,368 which was filed on Sep. 22, 2014.

BACKGROUND

This disclosure relates to a gas turbine engine variable stator vane assembly.

A gas turbine engine typically includes a fan section, a compressor section, a combustor section and a turbine section. Air entering the compressor section is compressed and delivered into the combustor section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Some gas turbine engines employ one or more variable stator vane stages. The vanes are rotated about a radial axis to vary the flow through a compressor section, for example, to avoid stall or surge conditions. A variable stator airfoil must be designed to be aerodynamically efficient in more than one angular position. As a result, compromises must be made in the design of the airfoil.

SUMMARY

In one exemplary embodiment, a gas turbine engine includes a stator stage arranged in a core flow path that includes a vane that is configured to be retractable from the core flow path during engine operation.

In a further embodiment of the above, the stator stage includes a retractable set of vanes that includes the vane and comprising an actuator assembly that is configured to move the vane in a generally radial direction between an extended position and a retracted position.

In a further embodiment of any of the above, the stator stage includes a fixed set of vanes that are arranged in circumferentially alternating relationship with the retractable set of vanes.

In a further embodiment of any of the above, the actuator assembly includes an actuator that is operatively connected to multiple vanes of the retractable set of vanes. The actuator is common to the multiple vanes.

In a further embodiment of any of the above, the vane includes an end that is spaced from a flow surface in the retracted position. The flow surface defines a portion of the core flow path.

In a further embodiment of any of the above, the flow surface is an outer flow surface.

In a further embodiment of any of the above, the end abuts another flow path surface opposite the flow path surface in the extended position.

In a further embodiment of any of the above, the vane is configured to move between the extended and retracted positions along a non-linear path.

In a further embodiment of any of the above, the actuator assembly includes a screw that is operatively connected to the vane. A ring gear is operatively connected to the screw.

A motor is configured to rotate the ring gear to move the vane between the extended and retracted positions with the screw.

In a further embodiment of any of the above, the stator stage is arranged in a turbine section of the engine.

In a further embodiment of any of the above, the stator stage is arranged in a compressor section of the engine.

In a further embodiment of any of the above, the actuator assembly includes one of a hydraulic or fueldraulic system configured to move the vane.

In another exemplary embodiment, a method for varying flow through a stator stage includes the step of selectively retracting a stator vane in a generally radial direction from a core flow path.

In a further embodiment of the above, the retracting step includes moving multiple vanes simultaneously.

In a further embodiment of any of the above, the vanes are selectively retracted relative to fixed vanes within the same stage.

In a further embodiment of any of the above, the multiple vanes are retracted using a common actuator.

In a further embodiment of any of the above, the vanes are retracted along a linear path.

In a further embodiment of any of the above, the vanes are retracted along a non-linear path.

In a further embodiment of any of the above, the vanes are selectively retracted between extended and retracted positions and to a position between the extended and retracted position.

In a further embodiment of any of the above, the vane is retracted in a radial inward direction.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
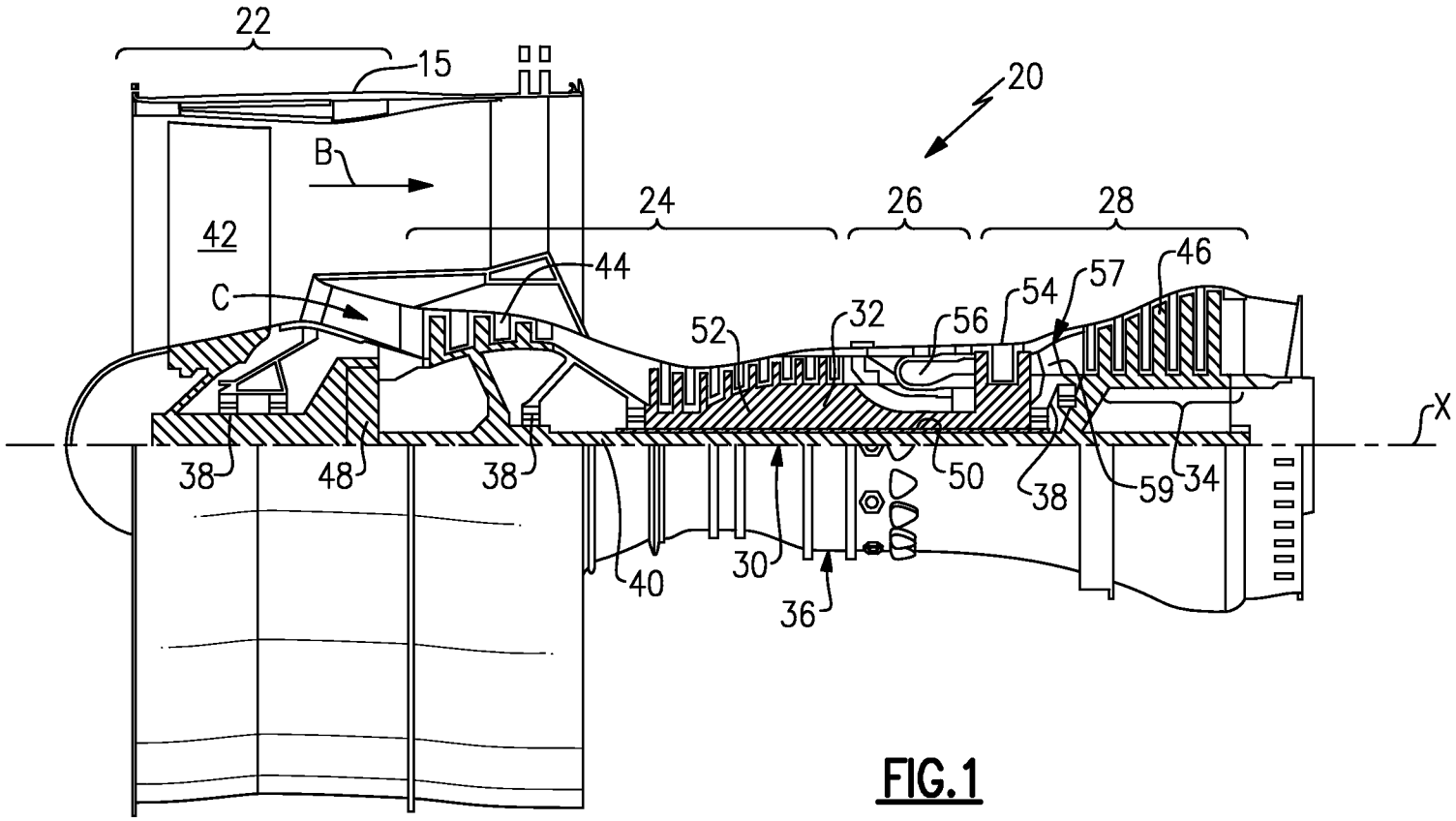
FIG. 1 schematically illustrates a gas turbine engine embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis X relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis X which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7\ ^\circ\ \text{R})]^{0.5}$. The "Low corrected fan tip speed" as disclosed herein according to one non-limiting embodiment is less than about 1150 ft/second (350.5 meters/second).

Figure 2:
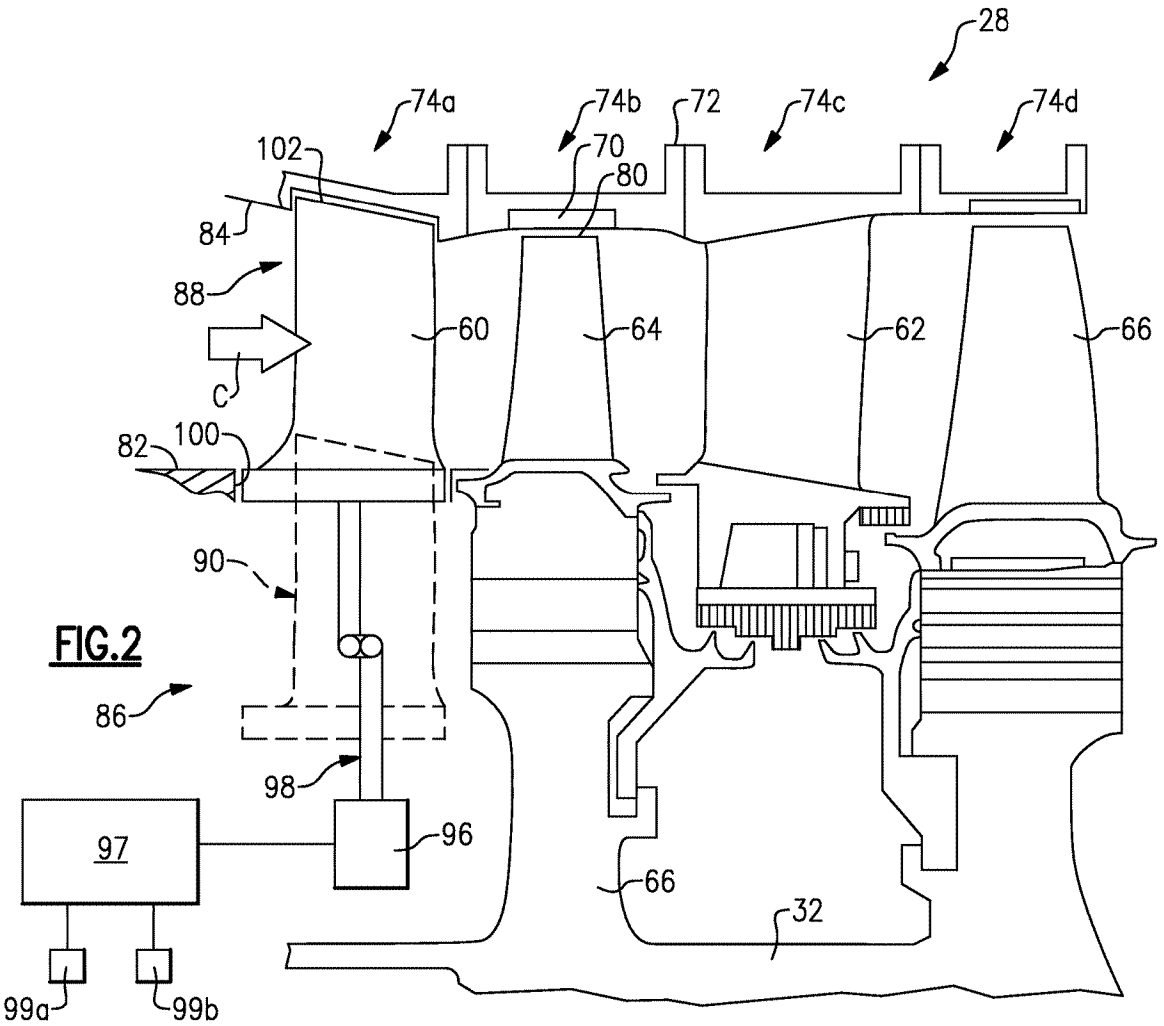
FIG. 2 is a cross-sectional view through a turbine section.

Referring to FIG. 2, a cross-sectional view through a turbine section 28 is illustrated. However, it should be understood that the disclosed variable stator vane assembly can also be used in the compressor section 24. In the example section, first and second arrays 74*a*, 74*c* of circumferentially spaced stator vanes 60, 62 are axially spaced apart from one another. A first stage array 74*b* of circumferentially spaced turbine blades 64, mounted to a rotor disk 66, is arranged axially between the first and second fixed vane arrays 74*a*, 74*c*. A second stage array 74*d* of circumferentially spaced turbine blades 66 is arranged aft of the second array 74*c* of fixed vanes 62. Any number of fixed and rotating stages can be used in a given engine section.

The turbine blades each include a tip 80 adjacent to a blade outer air seal 70 of a case structure 72. The first and second stage arrays 74*a*, 74*c* of turbine vanes and first and second stage arrays 74*b*, 74*d* of turbine blades are arranged within the core flow path C and are operatively connected to a spool 32.

Inner and outer flow surfaces 82, 84 define an annular core flow path within which the variable stator vane stage 74*a* is arranged. The stage 74*a* includes multiple selectively retractable circumferentially arranged vanes 60 that are moveable between an extended position 88 and a retracted position 90. The vanes 60 may also be partially retracted. In this manner, the flow through the stage 74*a* may be varied to address, for example, surge and stall conditions. The airfoils of vanes 60 may be designed with one angular position in mind to provide improved aerodynamic efficiency over traditional angularly variable stator vanes.

Figure 3A:
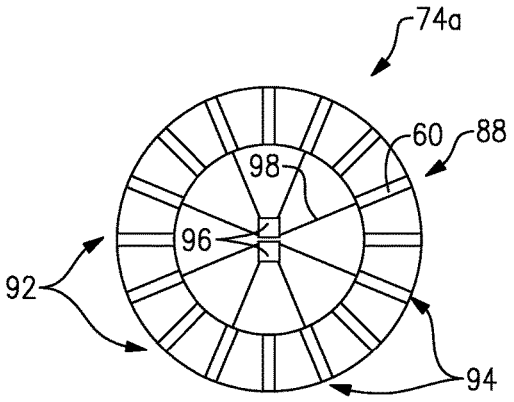
FIGS. 3A and 3B are schematic views of a stator stage with vanes in an extended position.

Referring to FIG. 3A, the stage 74*a* includes a set of fixed vanes 92 and a set of retractable vanes 94 arranged in alternating relationship in the example. Any suitable configuration may be used. Multiple fixed vanes may be arranged adjacent to one another, or all the vanes of a stage may be selectively retractable, for example.

Returning to FIG. 2, an actuator assembly 86 includes an actuator 96, operatively connected to the vane 60 by a linkage assembly 98. A controller 97 communicates with the actuator 96 and receives signals from various inputs 99*a*, 99*b*, such as temperature and pressure signals, takeoff and landing information and other parameters relating to engine and aircraft operation.

Figure 3B:
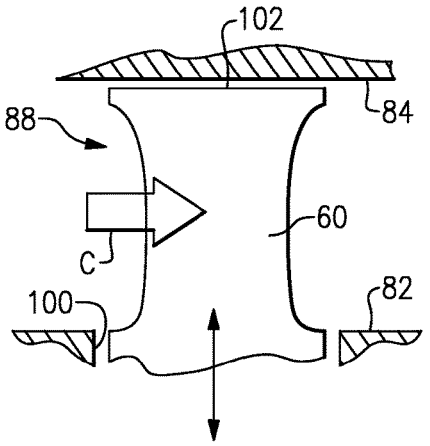
Figure 4A:
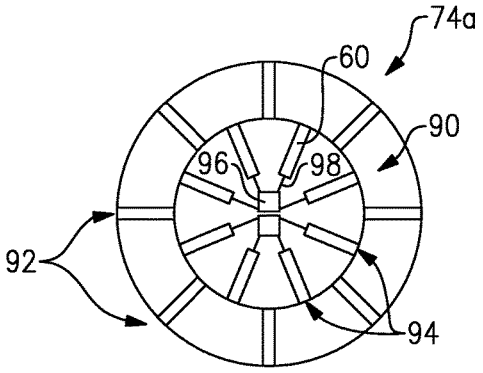
FIGS. 4A and 4B are schematic views of the stator stage with the vanes in a retracted position.
Figure 4B:
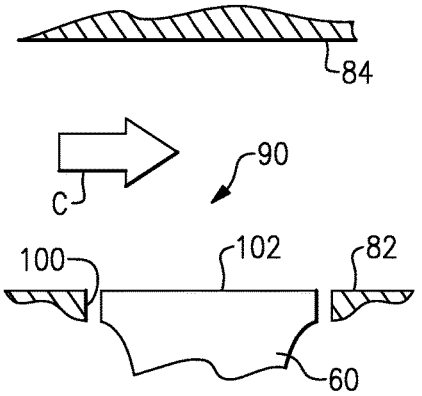
Figure 5:
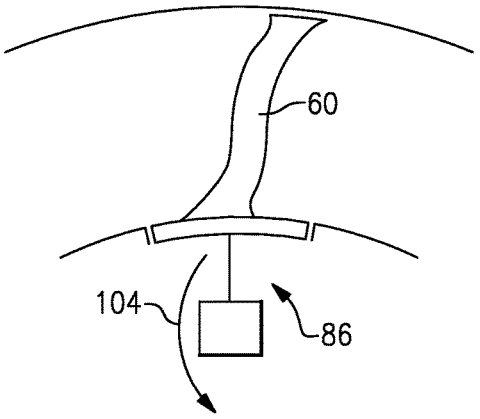
FIG. 5 is a schematic view of a vane and an actuator assembly configured to retract the vane along a non-linear path.

Each vane 60 is moveable with respect to an opening 100 arranged in the inner flow surface 82 in the example. An end 102 of the vane 60 is arranged adjacent to the outer flow surface 84 in the extended position, as shown in FIGS. 2 and 3B. A single actuator 96 may be operatively connected to multiple vanes, as shown in FIGS. 3A and 3B. The actuator 96 is configured to retract the vane 60 from the core flow path through the opening 100, as shown in FIG. 4B. Depending upon the configuration of the vane 60 and the actuator assembly 86, the vane 60 may be moveable along a non-linear path 104, as schematically shown in FIG. 5.

Figure 6A:
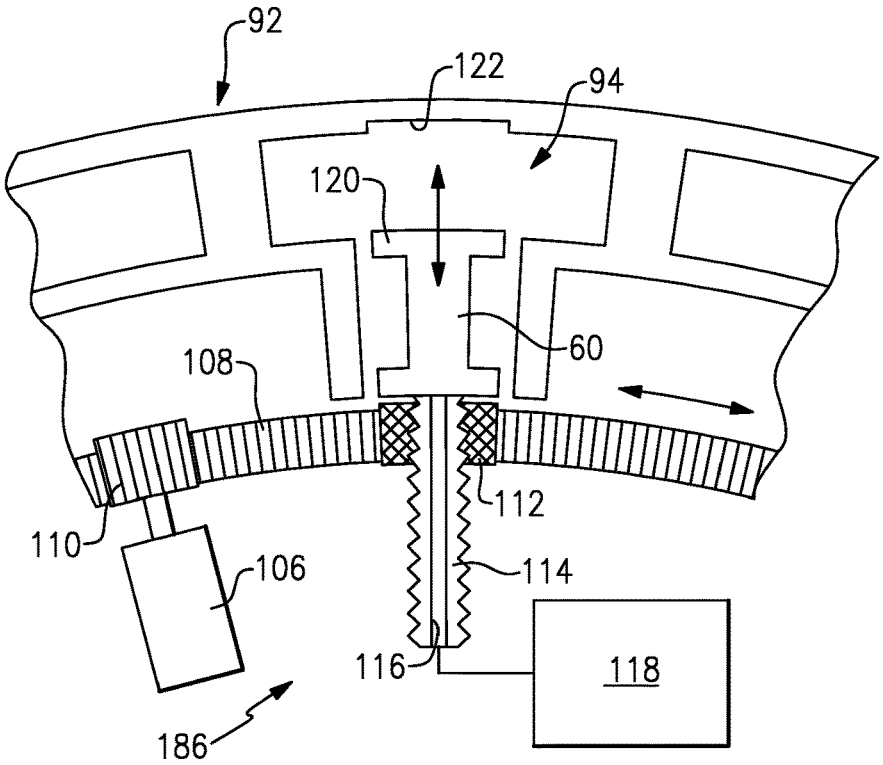
FIGS. 6A and 6B are schematic views of an example actuator assembly.
Figure 6B:
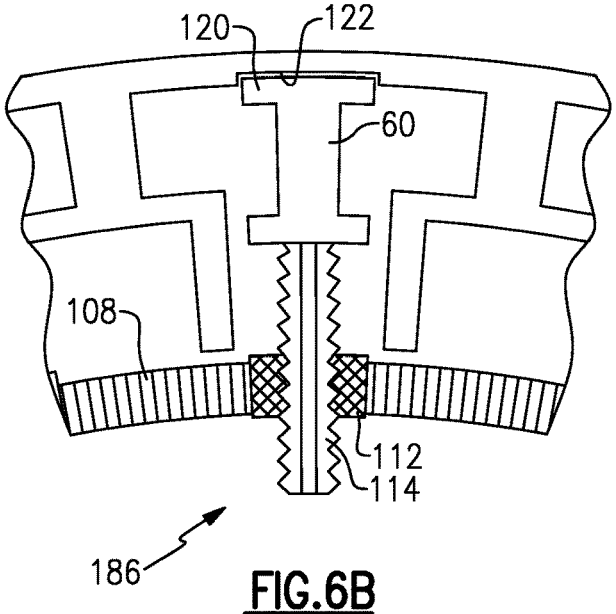

An example actuator system is shown in FIG. 6A and 6B. The actuator assembly 186 includes a motor 106 having a drive gear 110 that is coupled to a ring gear 108. A screw 114 is connected to the vane 60 and is received by nut 112 that meshes with the ring gear 110. The motor is configured to rotate the ring gear 108 to move the vane 60 between the extended and retracted position via the screw 114. In the example, a platform 120 of the vane 60 is received in a pocket 122 in the outer flow surface. In this manner, a single motor can actuate multiple vanes. A fluid passage 116 is provided through the screw 114 to communicate a cooling fluid from a cooling source 118, such as bleed air, to the vane 60 for cooling.

Figure 7:
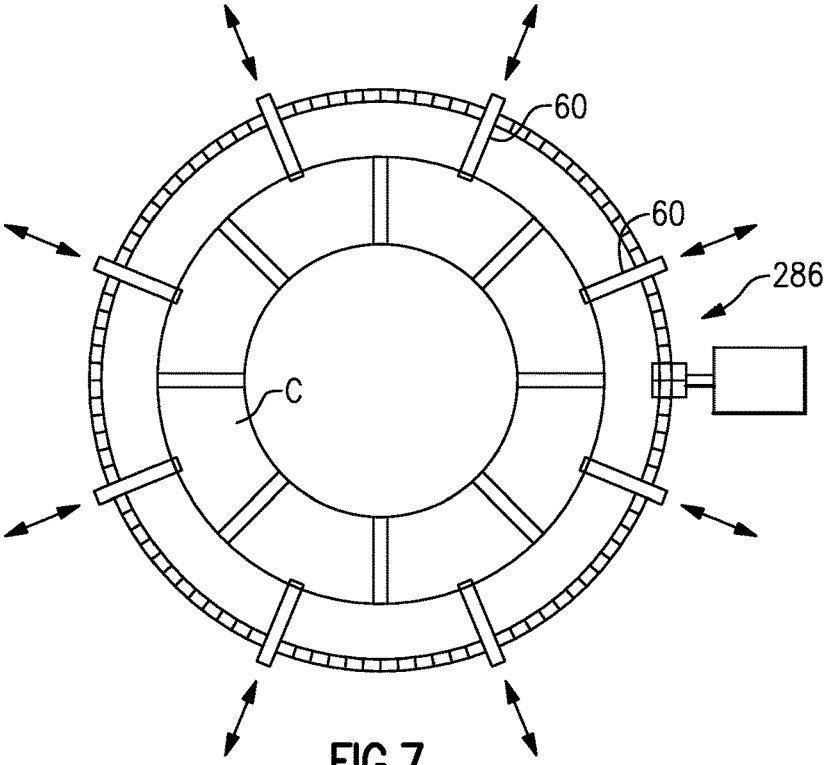
FIG. 7 is another example vane and actuator assembly configuration.

Referring to FIG. 7, the vanes 60 may be configured to move radially outward from the core flow path C by the actuator assembly 286.

Figure 8:
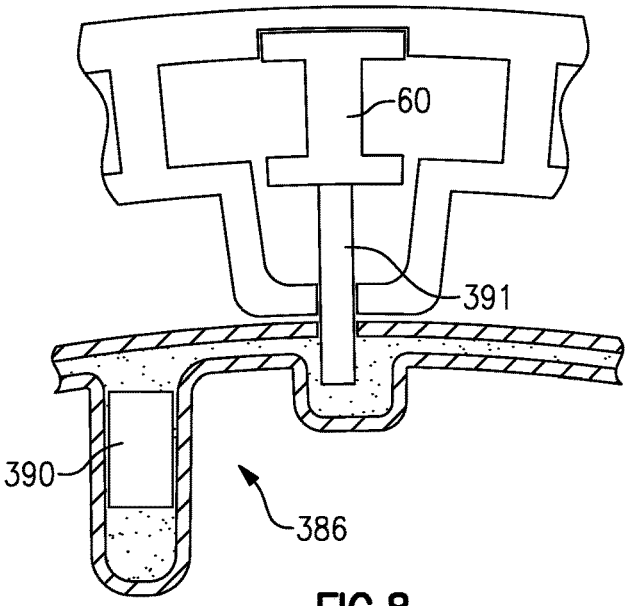
FIG. 8 is another example vane and actuator assembly configuration.

Another actuation assembly 386 is shown in FIG. 8. In one example, the assembly 386 uses a hydraulic or fueldraulic system in a master cylinder 390/-slave cylinder 391 arrangement to move the vanes 60.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A gas turbine engine comprising:

a stator stage including a retractable set of vanes arranged in a core flow path that extends in an axial direction relative to the gas turbine engine, each vane of the retractable set of vanes being moveable so as to be retracted from the core flow path into a retracted position or extended into the core flow path into an extended position during operation of the gas turbine engine; and an actuator assembly that includes a fueldraulic system and a master cylinder and a slave cylinder, the slave cylinder being in direct communication with one of the vanes, and the actuator assembly is configured to move the vane in a generally radial direction with respect to the axial direction between the extended position and the retracted position.

2. The gas turbine engine according to claim 1, wherein the stator stage is arranged in a turbine section of the gas turbine engine.

3. The gas turbine engine according to claim 1, wherein the stator stage includes a fixed set of vanes arranged in circumferentially alternating relationship with the retractable set of vanes.

4. The gas turbine engine according to claim 1, wherein the actuator assembly includes an actuator operatively connected to multiple vanes of the retractable set of vanes.

5. The gas turbine engine according to claim 4, wherein the actuator assembly includes a screw operatively connected to the vane, and a ring gear operatively connected to the screw, a motor configured to rotate the ring gear to move the vane between the extended and retracted positions with the screw.

6. The gas turbine engine according to claim 1, wherein the vane includes an end that is spaced from a flow surface in the retracted position, the flow surface defining a portion of the core flow path.

7. The gas turbine engine according to claim 6, wherein the end abuts another flow path surface opposite the flow path surface in the extended position.

8. A gas turbine engine comprising:

stator stage arranged in a core flow path that includes a vane that is configured to be retractable from the core flow path during operation of the gas turbine engine, wherein the core flow path extends in an axial direction, wherein the stator stage includes a retractable set of vanes that includes the vane; and wherein the stator stage comprises an actuator assembly configured to move the vane in a generally radial direction with respect to the axial direction and between an extended position and a retracted position, and the vane is configured to move between the extended and retracted positions along a non-linear path.

9. The gas turbine engine according to claim 8, wherein the stator stage includes a fixed set of vanes arranged in circumferentially alternating relationship with the retractable set of vanes.

10. The gas turbine engine according to claim 8, wherein the actuator assembly includes an actuator operatively connected to multiple vanes of the retractable set of vanes.

11. The gas turbine engine according to claim 10, wherein the actuator assembly includes a screw operatively connected to the vane, and a ring gear operatively connected to the screw, a motor configured to rotate the ring gear to move the vane between the extended and retracted positions with the screw.

12. The gas turbine engine according to claim 8, wherein the vane includes an end that is spaced from a flow surface in the retracted position, the flow surface defining a portion of the core flow path.

13. The gas turbine engine according to claim 12, wherein the end abuts another flow path surface opposite the flow path surface in the extended position.

14. A gas turbine engine comprising:

radially inner and outer flow surfaces defining a core flow path; and a stator stage arranged in the core flow path that includes a vane that is configured to be retractable from the core flow path during operation of the gas turbine engine, wherein the core flow path extends in an axial direction, wherein the stator stage includes a retractable set of vanes that includes the vane; and wherein the stator stage comprises an actuator assembly configured to move the vane in a generally radial direction with respect to the axial direction and between an extended position and a retracted position, and the vane includes an end that is spaced radially across the core flow path from the outer flow surface in the retracted position.

15. A gas turbine engine comprising:

a stator stage arranged in a core flow path and including a vane that is configured to be retractable from the core flow path during operation of the gas turbine engine by an actuator assembly, wherein the core flow path extends in an axial direction, and the stator stage is arranged in a compressor section of the gas turbine engine; and wherein the actuator assembly includes a screw operatively connected to the vane and a ring gear operatively connected to the screw, and the screw further comprises a fluid passage provided through the screw to communicate cooling fluid to the vane.

* * * * *